US010290944B2

(12) United States Patent
Bowers et al.

(10) Patent No.: US 10,290,944 B2
(45) **Date of Patent: *May 14, 2019**

(54) EFFICIENT ACTIVE MULTI-DRIVE RADIATOR

(71) Applicant: California Institute of Technology, Pasadena, CA (US)

(72) Inventors: Steven Bowers, Duarte, CA (US); Seyed Ali Hajimiri, La Canada, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 55 days.

This patent is subject to a terminal disclaimer.

(21) Appl. No.: 14/944,089

(22) Filed: Nov. 17, 2015

(65) Prior Publication Data

US 2016/0336660 A1 Nov. 17, 2016

Related U.S. Application Data

(63) Continuation of application No. 13/654,420, filed on Oct. 18, 2012, now Pat. No. 9,225,069.

(60) Provisional application No. 61/548,665, filed on Oct. 18, 2011.

(51) Int. Cl.

| | |
|---|---|
| ***H01Q 11/04*** | (2006.01) |
| ***H01Q 25/04*** | (2006.01) |
| ***H01Q 1/48*** | (2006.01) |

(52) U.S. Cl.

CPC ..... *H01Q 11/04* (2013.01); *H01Q 1/48* (2013.01); *H01Q 25/04* (2013.01)

(58) Field of Classification Search

None

See application file for complete search history.

(56) References Cited

U.S. PATENT DOCUMENTS

| | | | |
|---|---|---|---|
| 4,905,011 | A | 2/1990 | Shea |
| 5,014,070 | A | 5/1991 | Stock et al. |
| 5,030,962 | A | 7/1991 | Rees |
| 5,164,985 | A | 11/1992 | Nysen et al. |
| 5,751,248 | A | 5/1998 | Thaniyavarn |
| 5,886,671 | A | 3/1999 | Riemer et al. |
| 5,999,128 | A | 12/1999 | Stephens et al. |
| 6,140,972 | A | 10/2000 | Johnston et al. |

(Continued)

FOREIGN PATENT DOCUMENTS

| | | | |
|---|---|---|---|
| DE | 102006010003 | A1 | 6/2007 |
| EP | 0791878 | A2 | 8/1997 |

(Continued)

OTHER PUBLICATIONS

Babakhani, et al., "Transmitter Architectures Based on Near-Field Direct Antenna Modulation," IEEE Journal of Solid-State Circuits, vol. 43, No. 12, pp. 2674-2692, Dec. 2008.

(Continued)

*Primary Examiner* — Robert Karacsony

(74) *Attorney, Agent, or Firm* — Alston & Bird LLP

(57) ABSTRACT

An integrated Multi-Port Driven (MPD) antenna that can be driven at many points with different signals. An integrated MPD radiating source utilizing an 8-phase ring oscillator and eight power amplifiers to drive the MPD antenna at 161 GHz with a total radiated power of −2 dBm and a single element EIRP of 4.6 dBm has been demonstrated in silicon with single lobe well behaved radiation patterns closely matching simulation.

17 Claims, 13 Drawing Sheets

(56) References Cited

U.S. PATENT DOCUMENTS

| | | | |
|---|---|---|---|
| 6,313,792 | B1 | 11/2001 | Merlet et al. |
| 6,469,822 | B1 | 10/2002 | Zhu |
| 6,927,745 | B2 | 8/2005 | Brown et al. |
| 7,208,940 | B2 | 4/2007 | Withanawasm et al. |
| 7,352,328 | B2 | 4/2008 | Moon et al. |
| 7,372,406 | B2 | 5/2008 | Shiotsu et al. |
| 7,609,971 | B1 | 10/2009 | Zhou |
| 7,894,777 | B1 | 2/2011 | Rofougaran |
| 7,911,402 | B2 | 3/2011 | Rowson et al. |
| 8,319,549 | B2 | 11/2012 | Sengupta et al. |
| 8,432,326 | B2 | 4/2013 | Rofougaran et al. |
| 8,909,170 | B2 | 12/2014 | Rofougaran |
| 9,225,069 | B2 | 12/2015 | Bowers et al. |
| 9,621,269 | B2 | 4/2017 | Bowers et al. |
| 2001/0003442 | A1 | 6/2001 | Smith |
| 2003/0035610 | A1 | 2/2003 | Keys et al. |
| 2003/0080899 | A1 | 5/2003 | Lee et al. |
| 2003/0184479 | A1 | 10/2003 | Collins |
| 2003/0202801 | A1 | 10/2003 | Izadpanah |
| 2004/0184556 | A1 | 9/2004 | Kubo et al. |
| 2005/0242993 | A1 | 11/2005 | Hein |
| 2007/0047966 | A1 | 3/2007 | Hironishi et al. |
| 2007/0176836 | A1 | 8/2007 | Abramov et al. |
| 2008/0136720 | A1 | 6/2008 | Parsche et al. |
| 2009/0128413 | A1 | 5/2009 | Crouch et al. |
| 2009/0140724 | A1 | 6/2009 | Kentsch |
| 2009/0168818 | A1 | 7/2009 | Gollier et al. |
| 2009/0179798 | A1 | 7/2009 | Chiaretti et al. |
| 2009/0220030 | A1 | 9/2009 | Uhl et al. |
| 2010/0019332 | A1 | 1/2010 | Taylor |
| 2010/0045565 | A1 | 2/2010 | Izadpanah |
| 2010/0156747 | A1 | 6/2010 | Montgomery |
| 2010/0231452 | A1 | 9/2010 | Babakhani et al. |
| 2010/0265146 | A1 | 10/2010 | Montgomery et al. |
| 2011/0057712 | A1 | 3/2011 | Bowers et al. |
| 2011/0068807 | A1 | 3/2011 | Kesil et al. |
| 2011/0103801 | A1 | 5/2011 | Breunig et al. |
| 2011/0115677 | A1 | 5/2011 | Rao et al. |
| 2011/0170869 | A1 | 7/2011 | Mandai et al. |
| 2013/0278473 | A1 | 10/2013 | Bowers et al. |
| 2014/0062805 | A1 | 3/2014 | Bowers et al. |
| 2014/0161464 | A1 | 6/2014 | Bowers et al. |

FOREIGN PATENT DOCUMENTS

| | | | |
|---|---|---|---|
| KR | 10-2001-0096244 | A | 11/2001 |
| RU | 2414051 | C1 | 3/2011 |
| WO | WO 2010/015365 | A2 | 2/2010 |
| WO | WO 2012/094051 | A2 | 7/2012 |
| WO | WO 2013/112214 | A2 | 8/2013 |
| WO | WO 2013/123090 | A1 | 8/2013 |
| WO | WO 2013/123520 | A1 | 8/2013 |
| WO | WO 2014/018927 | A1 | 1/2014 |

OTHER PUBLICATIONS

Laskin, et al., "170-GHz Transceiver with On-Chip Antennas in SiGe Technology," Radio Frequency Integrated Circuits Symposium Digest (RFIC), pp. 637-640, Jun. 2008.

Park, et al., "A 0.38THz Fully Integrated Transceiver Utilizing Quadrature Push-Push Circuitry," Symp. On VLSI Circuits (VLSIC), pp. 22-23, Jun. 2011.

Sengupta, et al., "A 0.28 THz 4x4 Power-Generation and Beam-Steering Array," International Solid State Circuits Conference Digest (ISSCC), pp. 9-11, Feb. 2012.

Sengupta, et al., "Distributed Active Radiation for THz Signal Generation," IEEE ISSCC Dig. Tech. Papers, Feb. 2011, pp. 288-289.

Sengupta, et al., "Sub-THz beam-forming using Near-field coupling of Distributed Active Radiator Arrays," Radio Frequency Integrated Circuits Symposium (RFIC), Jun. 2011.

Tang, et al., "A 144GHz 0.76cm-Resolution Sub-Carrier SAR Phase Radar for 3D Imaging in 65nm CMOS," International Solid State Circuits Conference Digest (ISSCC), pp, 264-266, Feb. 2012.

PCT International Preliminary Report on Patentability for application PCT/US2012/060698 dated Apr. 22, 2014.

PCT International Preliminary Report on Patentability for application PCT/US2013/052396 dated Jan. 27, 2015.

PCT International Search Report and Written Opinion of the International Searching Authority for application PCT/US2013/052396 dated Nov. 21, 2013.

PCT International Search Report for application PCT/US2012/060698 dated Jul. 18, 2013.

PCT Written Opinion of the International Searching Authority for application PCT/US2012/060698 dated Jul. 18, 2013.

U.S. Appl. No. 13/654,420, Non-Final Office Action dated Jan. 21, 2015.

U.S. Appl. No. 13/654,420, Notice of Allowance dated Aug. 19, 2015.

U.S. Appl. No. 13/654,420, Response to Non-Final Office Action dated Jul. 21, 2015.

U.S. Appl. No. 13/952,493, Final Office Action dated Oct. 23, 2015.

U.S. Appl. No. 13/952,493, Non-Final Office Action dated Mar. 2, 2015.

U.S. Appl. No. 13/952,493, Non-Final Office Action dated May 11, 2016.

U.S. Appl. No. 13/952,493, Response to Final Office Action dated Apr. 22, 2016.

U.S. Appl. No. 13/952,493, Response to Non-Final Office Action dated Sep. 1, 2015.

PCT International Preliminary Report on Patentability for application PCT/US2013/025989 dated Aug. 19, 2014.

PCT International Search Report and Written Opinion of the International Searching Authority for application PCT/US2013/025989 dated Jun. 3, 2013.

U.S. Appl. No. 13/766,667, Final Office Action dated Dec. 17, 2015.

U.S. Appl. No. 13/766,667, Non-Final Office Action dated Apr. 16, 2015.

U.S. Appl. No. 13/766,667, Notice of Allowance dated Jul. 13, 2017.

U.S. Appl. No. 13/766,667, Response to Final Office Action dated Jun. 14, 2016.

U.S. Appl. No. 13/766,667, Response to Non-Final Office Action dated Oct. 8, 2015.

U.S. Appl. No. 13/952,493, Notice of Allowance dated Dec. 2, 2016.

U.S. Appl. No. 13/952,493, Response to Non-Final Office Action dated Nov. 10, 2016.

U.S. Appl. No. 13/766,667, Notice of Allowance dated Oct. 31, 2017.

FIG. 15
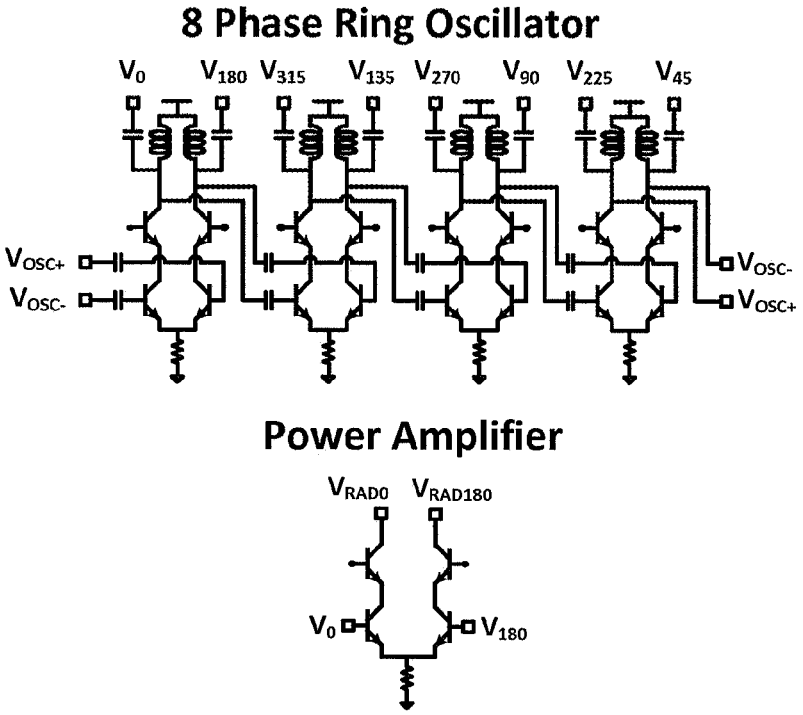
FIG. 16
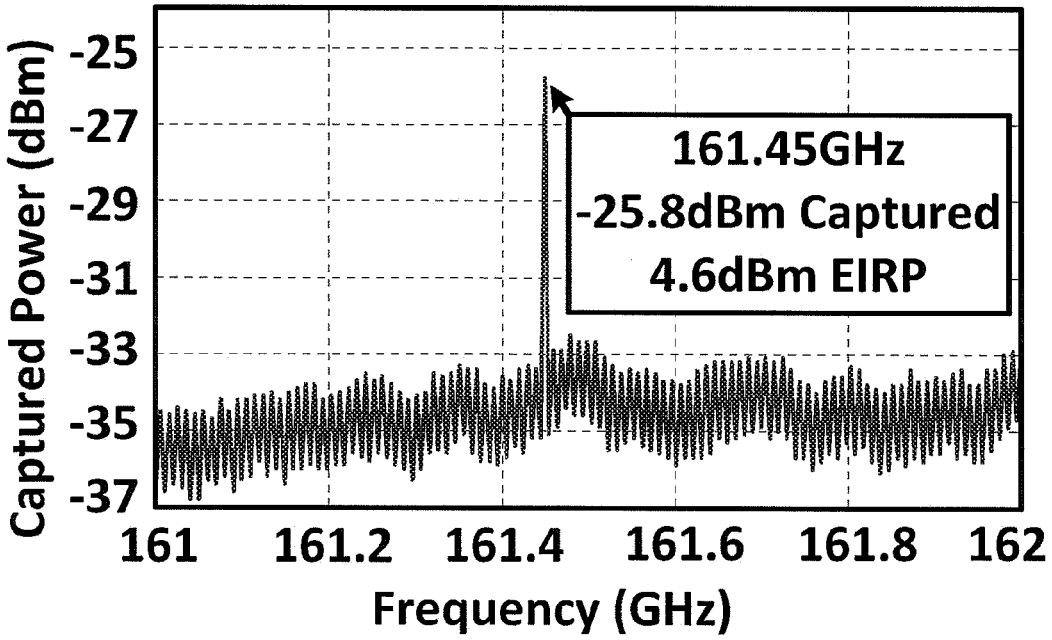
FIG. 17

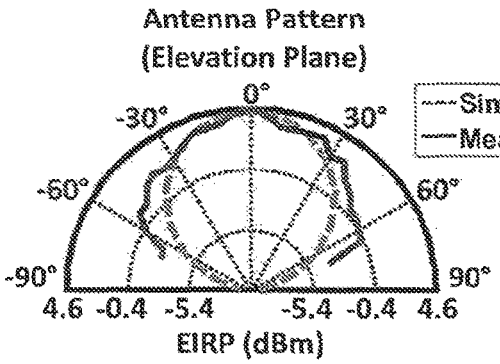
FIG. 18A
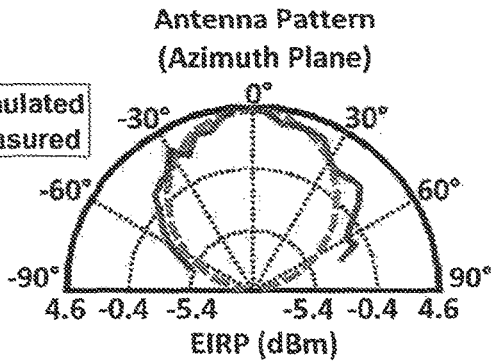
FIG. 18B
| Reference | Frequency | Total Radiated Power | Maximum EIRP | Process | Number of Elements | DC Power Consumption |
|---|---|---|---|---|---|---|
| This work | 161 GHz | -2.0dBm | 4.6dBm | 130nm SiGe | 16 | 326mW |
| [1] | 191 GHz | -12.4dBm | -1.9dBm | 65nm CMOS | 4 | 77mW |
| (ISSCC '11) [2] | 280 GHz | -7.2dBm | 9.4dBm | 45nm CMOS SOI | 16 | 877mW |
| [4] | 165 GHz | -27dBm | N/A | 130nm SiGe | 1 | 800mW (full transceiver) |
| (ISSCC '12) [9] | 199 GHz | N/A | -0.1dbm | 65nm CMOS | 1 | 217mW |
| [6] | 380 GHz | N/A | -13dBm | 130nm SiGe | 2 | 364mW (full transceiver) |
FIG. 20

EFFICIENT ACTIVE MULTI-DRIVE RADIATOR

CROSS-REFERENCE TO RELATED APPLICATIONS

This Application is a Continuation of Ser. No. 13/654,420, filed on Oct. 18, 2012 and entitled "EFFICIENT ACTIVE MULTI-DRIVE RADIATOR", which Application claims the benefit of priority to U.S. Provisional Application No. 61/548,665, filed on Oct. 18, 2011 and entitled "EFFICIENT ACTIVE MULTI-DRIVE RADIATOR", the contents of which are incorporated herein by reference in their entirety.

STATEMENT REGARDING FEDERALLY FUNDED RESEARCH OR DEVELOPMENT

This invention was made with government support under FA8650-09-C-7924 awarded by USAF/ESC. The government has certain rights in the invention.

FIELD OF THE INVENTION

The invention relates to antennas or radiators in general and particularly to an on-chip antenna or radiator.

BACKGROUND OF THE INVENTION

Wireless communication continues to increase in popularity, driving up the demand for wireless bandwidth. This has caused the spectrum at lower frequencies to become crowded. The need to be able to utilize additional spectrum at higher millimeter-wave frequencies has become critical. At the same time, the maximum operating frequencies of transistors, fmax, for example CMOS devices, have increased through transistor scaling to the point where it is feasable to integrate an entire transmitter system on a chip. However, there are several obsticles to overcome using technologies such as CMOS at these frequencies. In addition, because an efficient antenna must be at least around $\lambda/2$ in dimension, traditional antennas were fabricated off chip, and connected to the rest of the transmitter through a printed circuit board (pcb) or cable.

Traditional RF circuit design divides all circuit functionality into blocks, representing baseband circuitry, mixers, oscillators, phase rotators, amplifiers and antennas. Each block is designed separately, and the blocks are connected, often through only one connection, which can be either a single ended connection or a differential connection. Because the antenna is commonly fabricated off chip, and requires an external connection, most antennas have a single drive point, requiring a single output from the power amplifier.

However, integrated power generation and particularly radiation present several challenges ranging from on-chip power combining and impedance matching to off-chip power transfer. The traditional power transfer methods (e.g., bonding wires and solder balls or solder bumps) to off-chip loads (e.g., external antenna) also become increasingly ineffective.

At the same time, the smaller wavelengths associated with these frequencies opens up the possibility of radiating the power directly from the chip itself, rather than losing significant power by electrically connecting to an off-chip antenna. The low breakdown voltages of integrated silicon transistors encourages the use of large transistors or highly parallel transistors for high power generation, leading to low optimal load impedances from the active driver's perspective. Unfortunately, this directly conflicts with single-port antenna impedance level trade-offs, where a large radiation resistance compared to the loss resistance is preferred for high efficiency.

Among the disadvantages of the traditional approach at these frequencies are the losses incurred in transmission lines and interconnects and the low gain available in amplifier stages. Impedance matching networks on chip often can induce several dB of loss, and efficient inteconnects to an off chip-board or cable are not feasable or rugged enough for mass production. A design approach is needed that can remove as much unnessisary loss in the transmitter chain as possible.

There is a need for improved systems and methods that permit integrated chips to efficiently and effectively radiate power in the millimeter wave regime.

SUMMARY OF THE INVENTION

According to one aspect, the invention features a multi-port driven antenna. The multi-port driven antenna, comprises an antenna structure having a length L, the antenna structure comprising a conductor and configured to radiate electromagnetic radiation, the radiator structure having at least one ground contact point and a plurality S of input ports, where S is a positive integer greater than or equal to 2, each of the plurality S of input ports having a respective electrical connection to the antenna at a respective selected location along the antenna length L; and a respective signal input terminal of each of the plurality S of input ports, each signal input terminal configured to receive a respective input signal having a predetermined phase relationship with respect to another input signal applied an adjacent signal input terminal, the predetermined phase relationship dependent on the location of the respective electrical connection to the antenna, the respective signal input terminal configured to apply the received respective signal to the antenna structure at the respective selected location of the input port.

In one embodiment, the multi-port driven antenna further comprises a source of input signals, the source configured to provide to each of the respective signal input terminal of each of the plurality S of input ports the respective input signal having a predetermined phase relationship with respect to another input signal applied an adjacent signal input terminal, and configured to provide a ground signal at each of the at least one ground contact point; the multi-port driven antenna and the source of input signals when active defining a multiport-driven radiator.

In another embodiment, the source of input signals includes an amplifier configured to amplify at least one of the respective input signals.

In yet another embodiment, the antenna structure having a length L is a loop structure.

In still another embodiment, each of the plurality S of input ports has a respective electrical connection separated by a length L/S from a location of an adjacent input port.

In a further embodiment, the signal source is a multi-phase oscillator.

In yet a further embodiment, the multi-phase oscillator is configured to provide $2^X$ phases, where X is an integer greater than or equal to 2.

In an additional embodiment, the antenna is configured to radiate millimeter wave electromagnetic radiation.

In one more embodiment, the multi-port driven antenna is fabricated on a semiconductor wafer.

In still a further embodiment, the multi-port driven antenna further comprises at least one ground plane adjacent the loop antenna structure.

In a further embodiment, the multi-port driven antenna further comprises a controller configured to control an amplitude and a phase of each of the respective input signals.

In yet a further embodiment, the multi-port driven antenna further comprises a controller configured to control a power supply.

In an additional embodiment, the multi-port driven antenna is configured as one of a plurality of multi-port driven antennas in a phased array configuration.

In one more embodiment, the antenna structure having a length L is a linear structure.

According to another aspect, the invention relates to a method of generating electromagnetic radiation. The method comprises the steps of: providing an antenna comprising: an antenna structure having a length L, the antenna structure comprising a conductor and configured to radiate electromagnetic radiation, the radiator structure having at least one ground contact point and a plurality S of input ports, where S is a positive integer greater than or equal to 2, each of the plurality S of input ports having a respective electrical connection to the antenna at a respective selected location along the antenna length L; and a respective signal input terminal of each of the plurality S of input ports, each signal input terminal configured to receive a respective input signal having a predetermined phase relationship with respect to another input signal applied an adjacent signal input terminal, the predetermined phase relationship dependent on the location of the respective electrical connection to the antenna, the respective signal input terminal configured to apply the received respective signal to the antenna structure at the respective selected location of the input port; applying each of a plurality S of input signals each having a frequency ω to a respective signal input terminal of each of the plurality S of input ports; and observing an electromagnetic radiation output signal at a frequency ω.

In one embodiment, the integer S is three or larger.

In another embodiment, the integer S is a power of 2.

In yet another embodiment, the integer S is 8.

In still another embodiment, the electromagnetic radiation is millimeter wave electromagnetic radiation.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 15 is a schematic circuit diagram of an 8-phase ring oscillator and power mixer, in which the bias circuitry is omitted for simplicity.

FIG. 16 is a circuit diagram of a power amplifier.

FIG. 17 is a graph of a calibrated measured spectrum.

FIG. 18A is a plot of the simulated and measured antenna patterns in the elevation plane.

FIG. 18B is a plot of the simulated and measured antenna patterns in the azimuth plane.

FIG. 20 is a table providing a comparison of integrated (on-chip) silicon radiators above 100 GHz.

DETAILED DESCRIPTION

Figure 1:
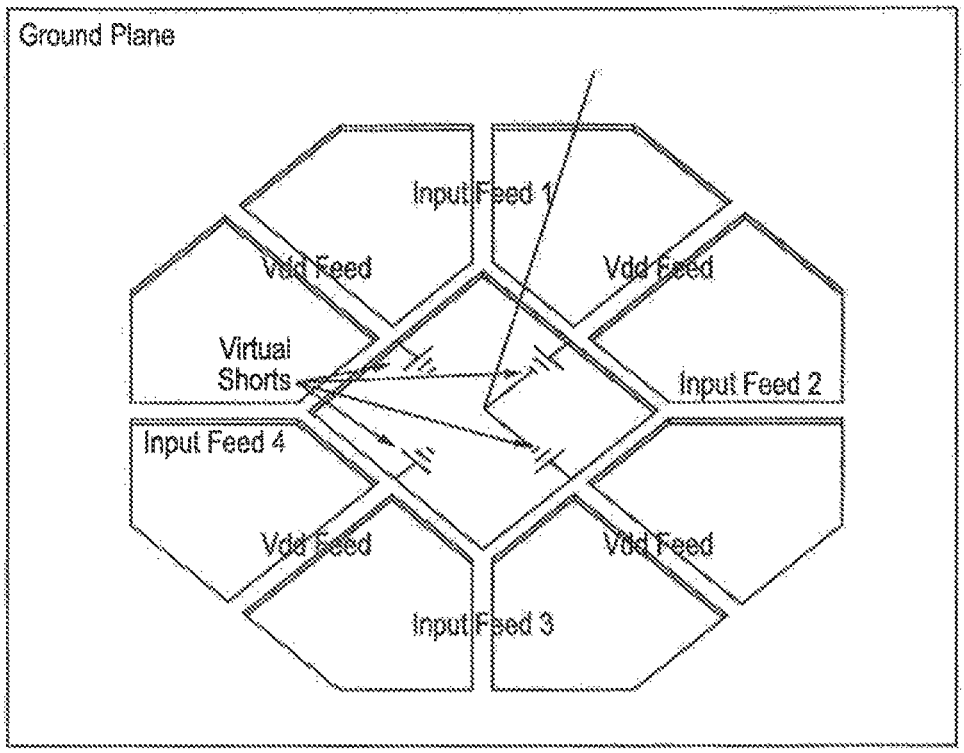
FIG. 1 is a schematic diagram of an active multi-drive radiator according to principles of the invention.

The ability to implement complex structures on silicon chips combined with the high frequency capabilities of the transistors widens the available design space considerably. This enables an integrated Multi-Port Driven (MPD) antenna that can be driven at many points with different signals. As used in this document, the term "MPD antenna" is used to denote a passive conductor apparatus by itself. An MPD antenna as contemplated herein is a conductor, in a linear structure or a loop structure, having multiple input ports or input terminals, each of which is intended to be driven at the same time as the others, such that, if one input port were to become inactive or be disconnected, the MPD antenna would remain active, but might not behave as intended. As used herein, the term "loop" or "loop structure" denotes a conductor that is formed in a closed path, without regard to the exact shape of the path (e.g., the shape can be circular, polygonal, or any other closed form as may be convenient). In an MPD antenna, superposition of the signals provided by multiple driving sources takes place. By comparison, a phased array of antennas is a structure that comprises a plurality of individual antennas, each of which is driven at a single input terminal, such that, if the input to one of the input terminals were to become inactive or be disconnected, the antenna driven at that one input terminal would become inactive, but the other antennas would remain active. In each of the antennas in phased array, there is no superposition of signals from multiple sources.

Such MPD antennas can be used to overturn, or decouple, the trade-offs between the port impedance and antenna efficiency due to energy losses in the antenna. With careful design, taking advantage of the current superposition of many driving sources, low input impedance can be achieved directly at the antenna port while keeping the radiation efficiency high. An added advantage of the MPD structure is its intrinsic power combing capability, where local current combining results in far field power combing. This is particularly conducive to silicon integrated power generation. Thus, an MPD antenna provides an efficient way to transfer and radiate power off chip, while concurrently performing impedance matching and power combining.

A multi-port driven (MPD) antenna allows for the removal of RF blocks for impedance matching, power combining, and power delivery by enabling efficient radiation from several output stages driving the antenna. As used in this document, the term "MPD radiator" is used to denote an MPD antenna that is combined with driving circuitry. A theory of operation of such a MPD radiator is presented. One embodiment of a MPD radiating source utilizing an 8-phase ring oscillator and eight power amplifiers to drive the MPD antenna at 161 GHz with a total radiated power of −2 dBm and a single element EIRP of 4.6 dBm has been demonstrated in silicon with single lobe well behaved radiation patterns closely matching simulation.

While this invention is not limited to any given frequency range, it is presented in one embodiment as operating at millimeter-wave frequencies. In some embodiments, the antenna can be fabricated using on-chip metals as the conductor structure in the same processes as are used in fabricating integrated circuits. In other embodiments, other conductive materials can be used as the conductor in the antenna structure. The conventional assumption that the ampifying stages must connect to the antenna through a single connection is no longer valid if one can provide a sufficient level of integration on a chip, which takes advantage of the effectively "free" availability of (or extremely low cost of) transistors on chip. The many potential applications at millimeter-wave (mm-wave) frequencies combined with our ability to integrate a large number of high-speed transistors presents an opportunity to construct novel power generation and radiation architectures in silicon based integrated circuits. In such a regime, new designs of both amplifiers and antennas are possible. These new integrated transmitter-antennas are active radiators. What sets an active radiator apart from a traditional transmitter and antenna is the level of integration of the amplifiing transistors into the radiating structure itself.

A design approach is provided that can remove as much unnessisary loss in the transmitter chain as possible. In this approach, the blocks advantageously are all designed from a holistic point of view, rather than as individual blocks with 50Ω connections. The focus of this invention is the combination of the driving circuitry and antenna into one radiating structure including, in some embodiments, even the entire oscillator amplifier chain with the radiator.

Several different types of MPD radiators are described herein.

In one embodiment (First Embodiment), a loop MPD radiator has multiple input terminals spaced apart along the loop, all of which input terminals are driven with differential feeds, all of which have the same phase. An example of such a radiator is illustrated in FIG. 1.

Figure 8:
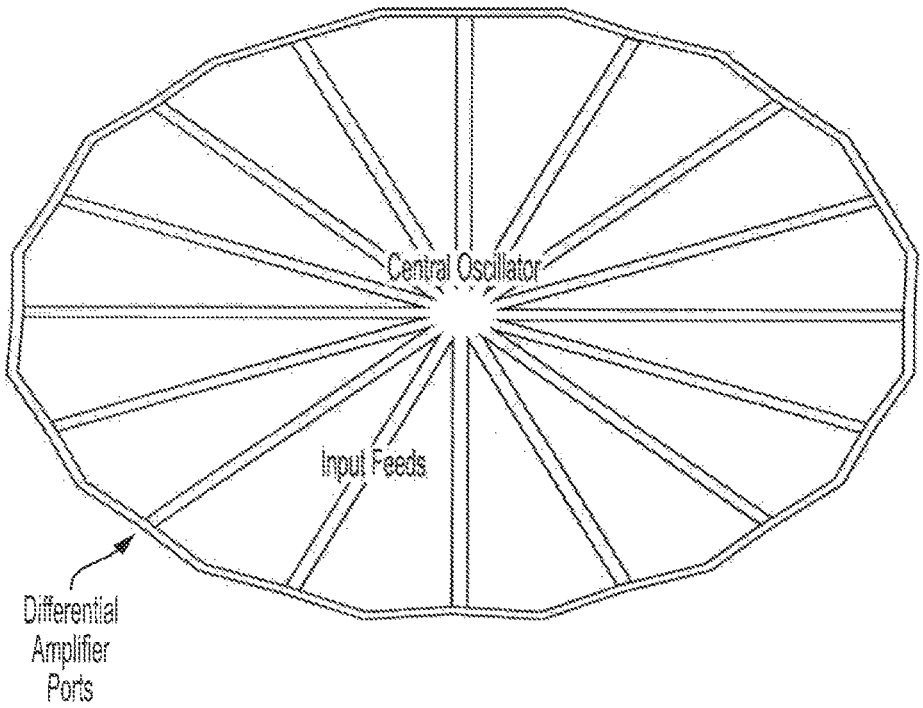
FIG. 8 is a schematic diagram of an embodiment of a differential radial multi-port driven radiator, with a loop topology.
Figure 11:
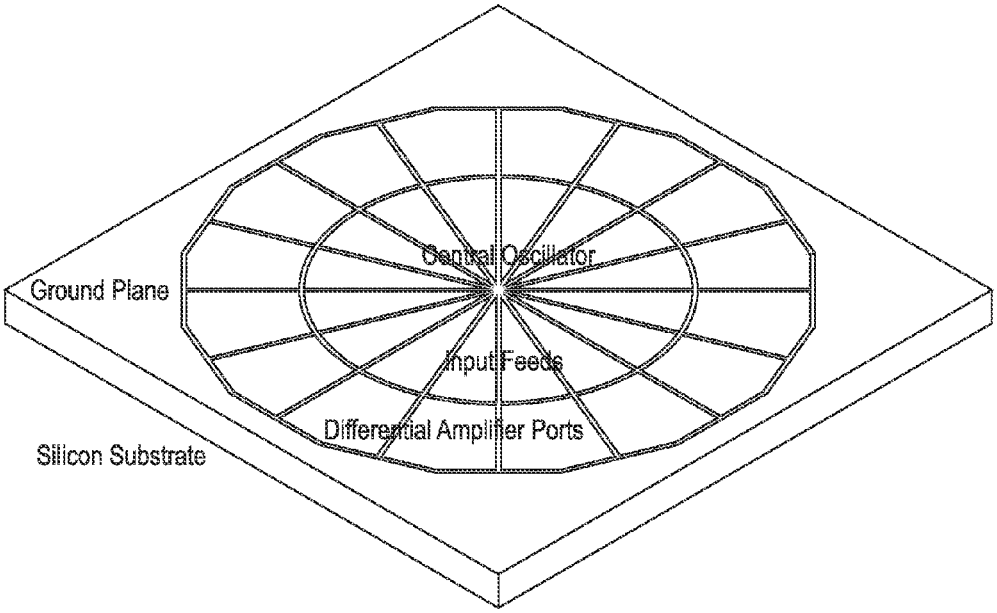
FIG. 11 is a schematic diagram of a second embodiment of a differential radial multi-port driven radiator in a loop topology.

In still another embodiment, a design termed a differential radial MPD radiator has a loop conductor with a plurality S of differential feeds which span a phase space of $2N\pi$, where N is an integer, and each feed has a phase shift of $2\pi N/S$ compared to each of the two adjacent feeds. Embodiments of this type of MPD radiator are shown in FIG. 8 and FIG. 11. The First Embodiment described above can be considered as a special case of this type of MPD radiator, with the condition that N=0.

In a further embodiment, termed a single ended radial MPD radiator, a loop conductor has a plurality S of single-ended feeds which span a phase space of $2N\pi$, where N is an integer, and each feed has a phase shift of $2\pi N/S$ compared to each of the two adjacent feeds. An example of such a single ended radial MPD radiator was fabricated and described herein, in conjunction with FIG. 14.

Figure 3:
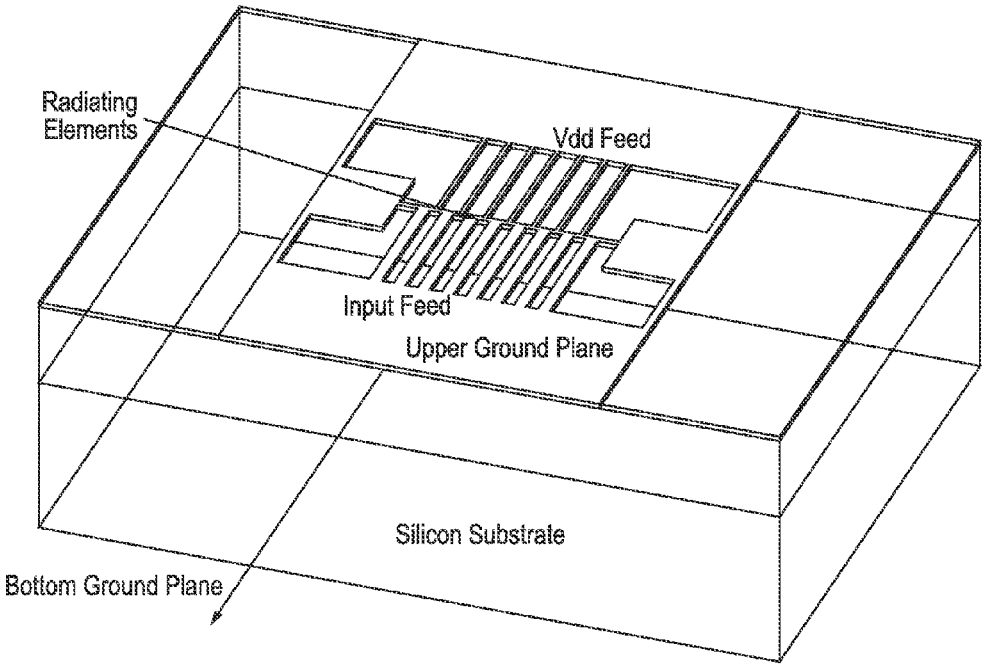
FIG. 3 is a schematic diagram of a linear device, a linear multi-port driven radiator, according to principles of the invention deposited on a silicon substrate.

Another embodiment involves a linear MPD radiator, in which a linear antenna structure is driven with differential feeds, where each feed is the same phase. An example of such a linear MPD radiator is illustrated in FIG. 3.

Yet another embodiment involves a linear MPD radiator, in which a linear antenna structure is driven with single ended feeds, where each feed is the same phase. Replacing the differential feeds of the example illustrated in FIG. 3 with single ended feeds is such an embodiment.

The phase shifts between the successive feeds in the linear embodiments need not be discreet levels, such as the $2\pi N/S$ shift that is required in a loop topology, but rather can be done by shifting by any real number R radians from one feed to the adjacent feed. Such phase shifting is expected to be useful for beam steering, in a similar way to phase shifting in a conventional phased array.

In the MPD antennas used in the MPD radiators described in the embodiments given above, it is tacitly assumed that, for three or more input ports, the spacing between each pair of adjacent input ports is the same spacing, and the frequency difference between the driving signals applied between any two adjacent input ports is the same frequency difference. These criteria, which can be thought of as defining a periodic structure which is driven with a series of driving signals differing by a constant offset in phase between successive input signals applied to successive input ports, are one convenient way to design MPD antennas and MPD radiators according to principles of the invention. However, there is a more general approach that can be used, of which the periodic design just described is a special case.

The more general design can be understood by first considering how the periodic design functions, and then generalizing. In the periodic design, as will be explained in greater detail hereinbelow, there exist a number of waves having a frequency determined by the common frequency of the input signals that traverse the periodic structure. In the general case, one can take the waves to be sinusoids, which are the basis functions in a Fourier analysis. By calculating the phase of such waves at any location along either a linear MPD antenna or a loop MPD antenna, one can determine the relative phases that will be exhibited at any multiple number of locations along the antenna. Therefore, by applying the principle of superposition, one could in principle drive such an antenna in an equivalent manner by selecting any multiple number of locations along the antenna, which locations need not be arranged in a periodic spacing arrangement but rather can be situated at any convenient distances from each other (or at a series of distances measured from one location considered to be the "starting location") that one may select, determining the mutual phase relationships that would exist between each successive pair of such selected locations, and constructing an equivalent antenna having the same number of input ports as the corresponding periodic antenna, but with input ports situated at the selected locations, and operated by driving each such input port with a signal having a phase difference from its adjacently applied input signal equal to the calculated phase difference between the respective locations of the adjacent input ports of the aperiodic array, which calculation is most conveniently performed by using the periodic model already discussed. See FIG. 13B Placing driving signal ports at selected locations, which may be non-regular points on the structure, can change the location of low impedance nodes or virtual shorts, but because the drives are often low impedance power sources, they can still provide drive power even if the impedance looking into the input port becomes very low. This is the most general configuration that can be produced for an MPD antenna in either linear or loop configuration, and is believed to be a technically feasible solution that provides a suitable MPD antenna and MPD radiator design. Clearly, if one were to "select" the multiple input port locations to be periodic and to supply the corresponding input signals that are required, this general solution becomes one of the previously discussed periodic solutions.

One way to radiate power efficiently out of a lossy silicon substrate is to create a traveling wave current on a ring of approximately one wavelength in circumference, in a manner similar to a Distributed Active Radiator (DAR). This radiator is self-oscillating, because the reactive elements of the antenna are also the reactive elements of the oscillator, and is not driven. The DAR radiates a harmonic frequency, and not the fundamental frequency. The DAR discussed in K. Sengupta and A. Hajimiri, "Distributed active radiation for THz signal generation," in IEEE ISSCC Dig. Tech. Papers, February 2011, pp. 288-289, which describes the integration of an oscillator, a frequency doubler and a radiator into one structure. See also K. Sengupta and A. Hajimiri, "Sub-THz beam-forming using near-field coupling of Distributed Active Radiator arrays," *Radio Frequency Integrated Circuits Symposium* (*RFIC*), June 2011 and K. Sengupta and A. Hajimiri, "A 0.28 THz 4×4 power-generation and beam-steering array," *International Solid State Circuits Conference Digest* (*ISSCC*), pp. 256-258, February 2012.

Another type of integrated design is the Direct Antenna Modulation ("DAM"), discussed in A. Babakhani, D. B. Rutledge, and S. A. Hajimiri, "Transmitter Architectures Based on Near-Field Direct Antenna Modulation," *Solid-State Circuits, IEEE Journal of*, vol. 43, no. 12, pp. 2674-2692, December 2008, which describes the integration of the antenna and modulation blocks into one structure. This structure is a single port dipole on a chip with configurable passive reflectors placed around it. The power is only added from a single port, and is not driven by multiple ports.

Unlike the DAR, our MPD radiating source is driven essentially unilaterally by the signal generation block at the fundamental frequency, eliminating the back coupling from the radiator itself.

The efficient active multi-drive radiator of the invention uses a plurality of drive points on a single radiating structure to create an efficient radiator. It utilizes the electical interdependence between drive points to allow electromagnetic situations not possible with a single drive port or single drive point. It is possible to use a plurality of efficient active multi-drive radiators in a phased array configuration to further increase desired performance specifications.

Because the breakdown voltage of the transistors limit the maximum voltage at the drain of the amplifier, in order to increase power, one can only increase current. This implies that for high power devices, the output impedance preferably should be much below the load impedance that tradional antennas are designed to present. One option is to provide a matching network that transforms the low impedance of the transistor output to the higher impedance of the antenna. Alternatively, one can design a radiator to present a low input impedance to the amplifier transistor so as to eliminate the need for a lossy matching network. The input impedance of a radiating structure is determined by a combination of the reactive elements such as inductances (lumped or distributed), and capacitance (lumped or distributed), lossy resistance and radiation resistance. For a wire-type radiator, similar to a traditional dipole or loop, one can gain additional intuition about the the input impedance by treating or modeling the antenna as a transmission line of the same length with extra loss due to the radiation impedance. The termination of that line should either be open or short, in order to avoid dumping power into a terminal resistance which would decrease efficiency.

Using the transmission-line analogy, in order to have a low impedance with open ends, the length from the amplifier to the open circuit should be of the order of $\lambda/4$ (e.g., one-quarter wavelength), but due to the radiation impedance, the radiation resistance alone is 36.5Ω. Even without the loss resistance, that is a higher impedance than one would hope to achieve. In one particular standard CMOS 65 nm process, the input impedance of one such stage is 10+10j. One additional issue is that a $\lambda/4$ line is quite large, and one might prefer to have several stages on a single chip to increase output power.

Alternatively, one can consider having a short at the end of the line. At first this does not look possible, as having a short would imply returning the end of the line back to the amplifing transistor in some sort of a loop. However, a loop that is that small has very low radiation efficiency, as the current around the loop is essentially constant, and the opposing currents from opposite sides of the loop are very close together. However, the use of a virtual short allows for separation of the opposing currents and makes higher radiation efficiency levels possible. In one embodiment, in order to achieve this virtual short, differential drivers are placed at the corners of a square as seen in FIG. 1. FIG. 1 is a schematic diagram of an active multi-drive radiator according to principles of the invention.

By symmetry, the midpoint of each line will be a virtual short as each end is being driven differentially. This will have the effect of making a large loop with constant current around the entire loop, as long as the the length of half of a side of the square (mr) is short enough that the current along it can be approximated as constant. By adjusting mr, the input impedance of each transistor stage can be adjusted. When mr=0, the impedance is 0. As mr increases, the imaginary part of the input impedance increases similarly to a shorted transmission line. At the same time, both the loss resistance and the radiation resistance will increase. Thus mr is set so that the input impedance matches the optimal load impedance of the amplifier stage, in this example, 10+10j. Because of the constant current on the loop, in the far field along the z axis (perpendicular to the plane of the antenna), opposing currents on opposite sides of the square will cancel out and it will not radiate in that direction, but instead will exhibit end fire radiation in the plane of the antenna, and will result in an annular antenna pattern. This will take advantage of the fact that on CMOS silicon, transistors can be placed at any point of the structure at no additional cost, and thus it becomes advantageous to drive the radiator from several points instead of a single feed point. This design is advantageous in applications where it is desired to radiate in the plane of the silicon chip. A limitation is that such a design can cause issues with substrate coupling and additional interference with other circuits located on the chip.

In the embodiment shown in FIG. 1, differential driving amplifiers are placed around the radiator and fed by input signals through transmission lines along the input feed lines. DC power is provided by the Vdd feed line that connects to the radiator at the virtual short. By connecting at the virtual short, the impedance seen looking into the Vdd feed line is no longer relevant as it will be in parallel to the virtual short, and thus a short will still be seen looking toward the virtual short from the output amplifier stages.

Figure 2:
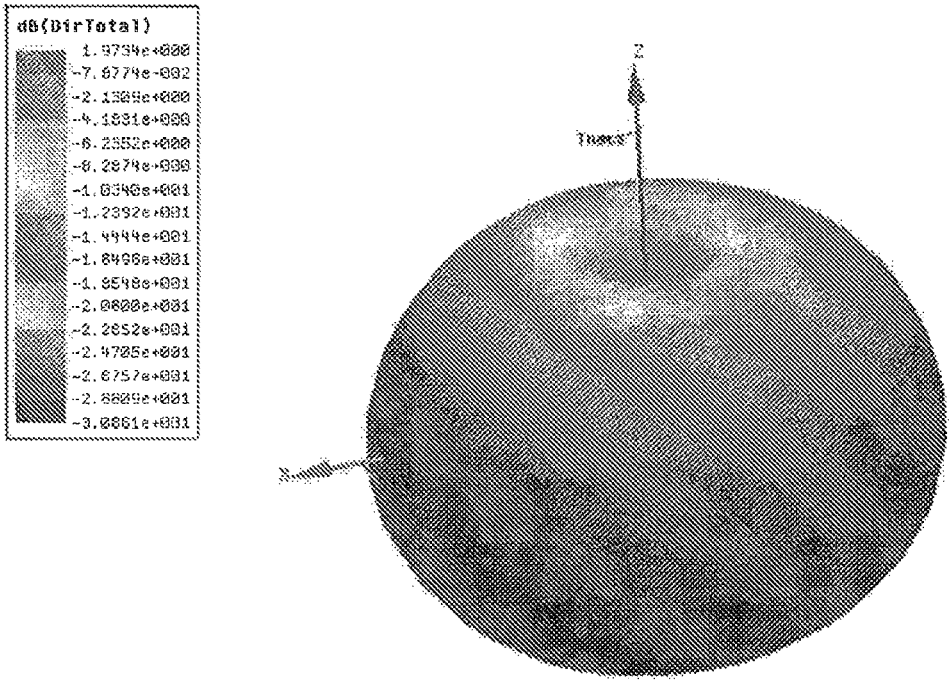
FIG. 2 is a three dimensional plot of radiation intensity as a function of direction for the embodiment of FIG. 1.

FIG. 2 is a three dimensional plot of radiation intensity as a function of direction for the embodiment of FIG. 1. As can be seen from the plot of directivity, this structure radiates along the XY plane, with very low directivity along the Z axis.

The linear multi-port driven radiator allows for out of plane radiation and still achieves low input impedance. If one makes a structure similar to the square standing wave radiator shown in FIG. 1, but that is completely linear, the currents no longer cancel out in the z direction. This works acceptably for many of the stages in the middle, but breaks down at the two ends where the virtual short no longer provides low impedance. Large blocks of metal are placed at these junctions to provide as low of an impedance as possible. These end stages will be much more lossy than their counterparts toward the center of the radiating structure, but they will provide the appropriate current sink allowing for all of the other virtual shorts in the center to occur. Because of this behavior, in order to maximize efficiency, it is desireable to make as many stages as possible. One possible design would be to put 8 differential stages in the radiator (having 16 driving points), but it could be extended to include as many stages as are necessary or as can be made available taking into consideration space and power constraints.

The linear multi-port driven radiator can be fed by an input divider similar to one used on a power-combining power amplifier (PA). Because the input feeds will be coming in perpendicular to the radiating structure, they will not interfere with the radiation very much. DC power can be delivered by attaching a VDD connection to the virtual grounds, and the DC ground can come in on the transmission line inputs. All of these lines can be perpendicular to the radiator currents.

Advantages provided by this structure include elimination of the interconnect to an off chip antenna, and also elimination of the the power combiner that would be required in a traditional PA to bring all 8 differential stages together to 1 differential output.

FIG. 3 is a schematic diagram of a linear device, a constant current dipole active radiator, according to principles of the invention deposited on a silicon substrate.

In one embodiment of the design shown in FIG. 3, a reflecting ground plane can be placed on the opposite side of the silicon substrate, to direct all of the energy up in one direction. By carefully selecting the dimensions of the substrate, a maximum amount of radiated power can be directed in the positive Z axis. Similar to the square standing wave active radiator described previously, the input signal is brought to the radiating elements through transmission lines. The lines then drive differential amplifying stages placed directly at the radiating elements. This structure will create a standing wave, and mimics a dipole that has more consistent current across it's line, but has the advantages of being driven at multiple drive points, all having low impedances.

Figure 4:
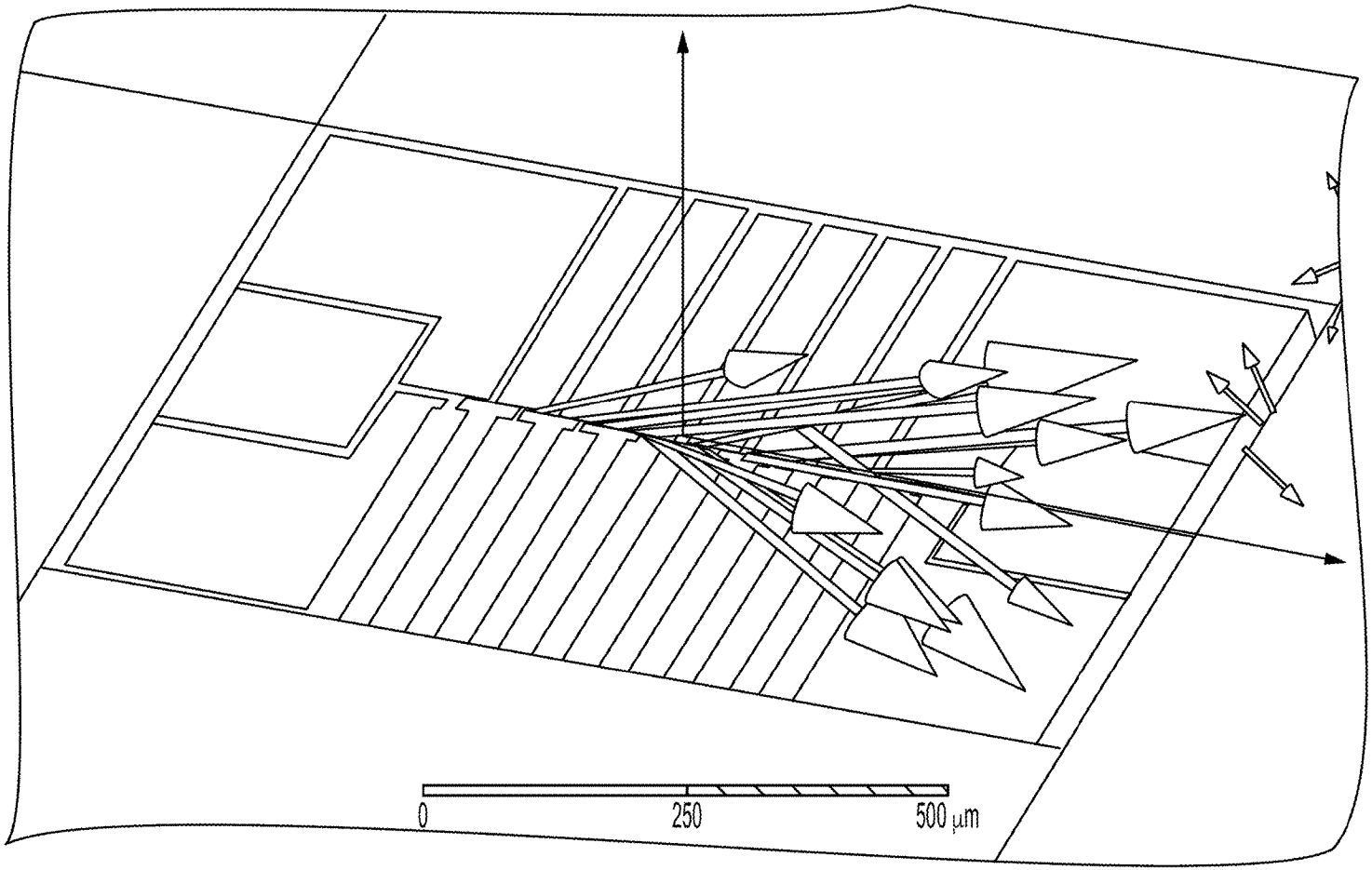
FIG. 4 is a plot of current density in the device of FIG. 3.

FIG. 4 is a plot of current density in the device of FIG. 3. As anticipated, the structure has a maximum amplitude of current toward the center, and less current toward the edges where the concept of the virtual short breaks down. In this embodiment, there are 8 pairs of output differential stages, but more could be added to increase output power and efficiency.

Figure 5:
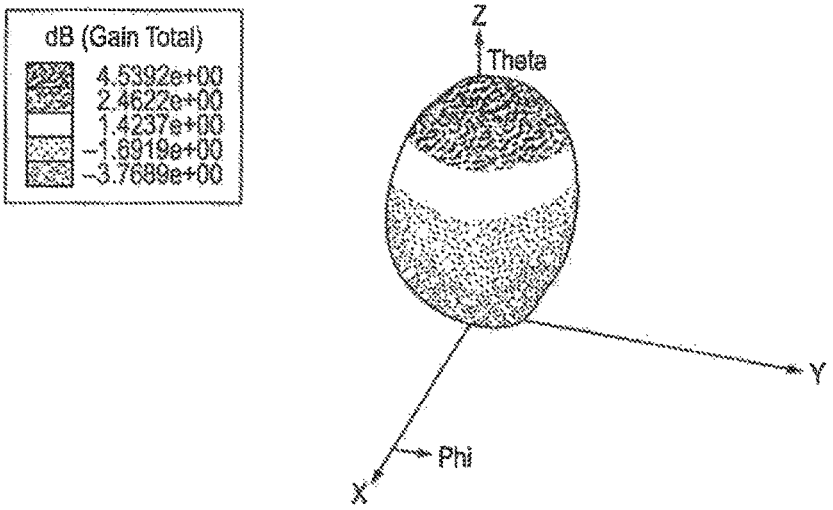
FIG. 5 is a three dimensional plot of the radiation gain pattern achieved by the device shown in FIG. 3 after tuning of the substrate.

FIG. 5 is a three dimensional plot of the radiation gain pattern achieved by the device shown in FIG. 3 after tuning of the substrate. The high directivity of this radiator allows it to send more power to a receiver using the same input power, leading to an overall increase in efficiency.

Figure 6:
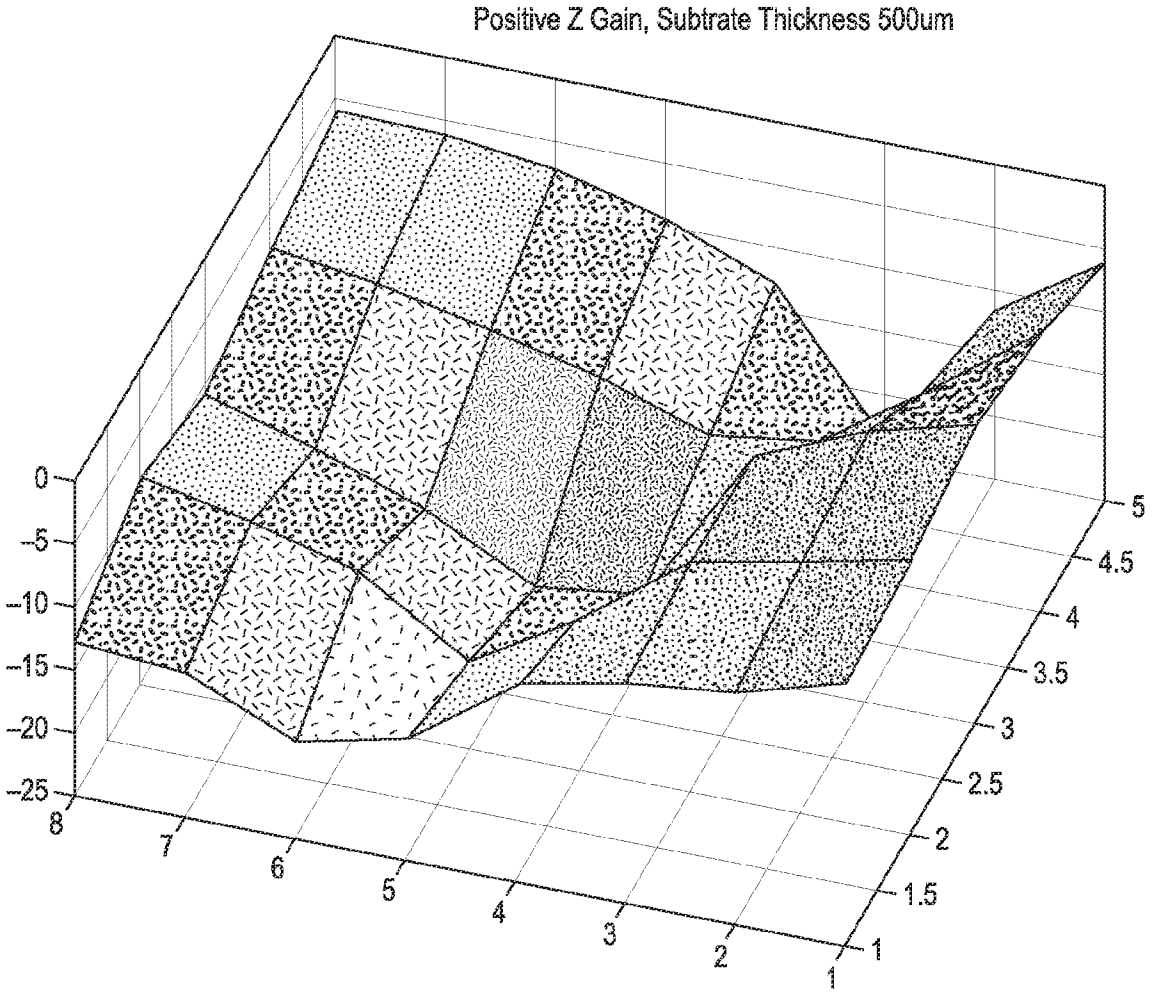
FIG. 6 is a three dimensional plot of gain as a function of variations in the x, y, and z dimensions of the device of FIG. 3.

FIG. 6 is a three dimensional plot of gain as a function of variations in the x, y, and z dimensions of the device of FIG. 3. The substrate can be tuned for maximum directivity by sweeping the x, y, and z dimensions and finding the trends that occur. FIG. 6 presents one example plot where the Z dimension (Zsub) is kept constant and the x and y are swept. Tuning of the substrate's dimensions is advantageous to avoid significant loss to substrate modes.

Figure 7:
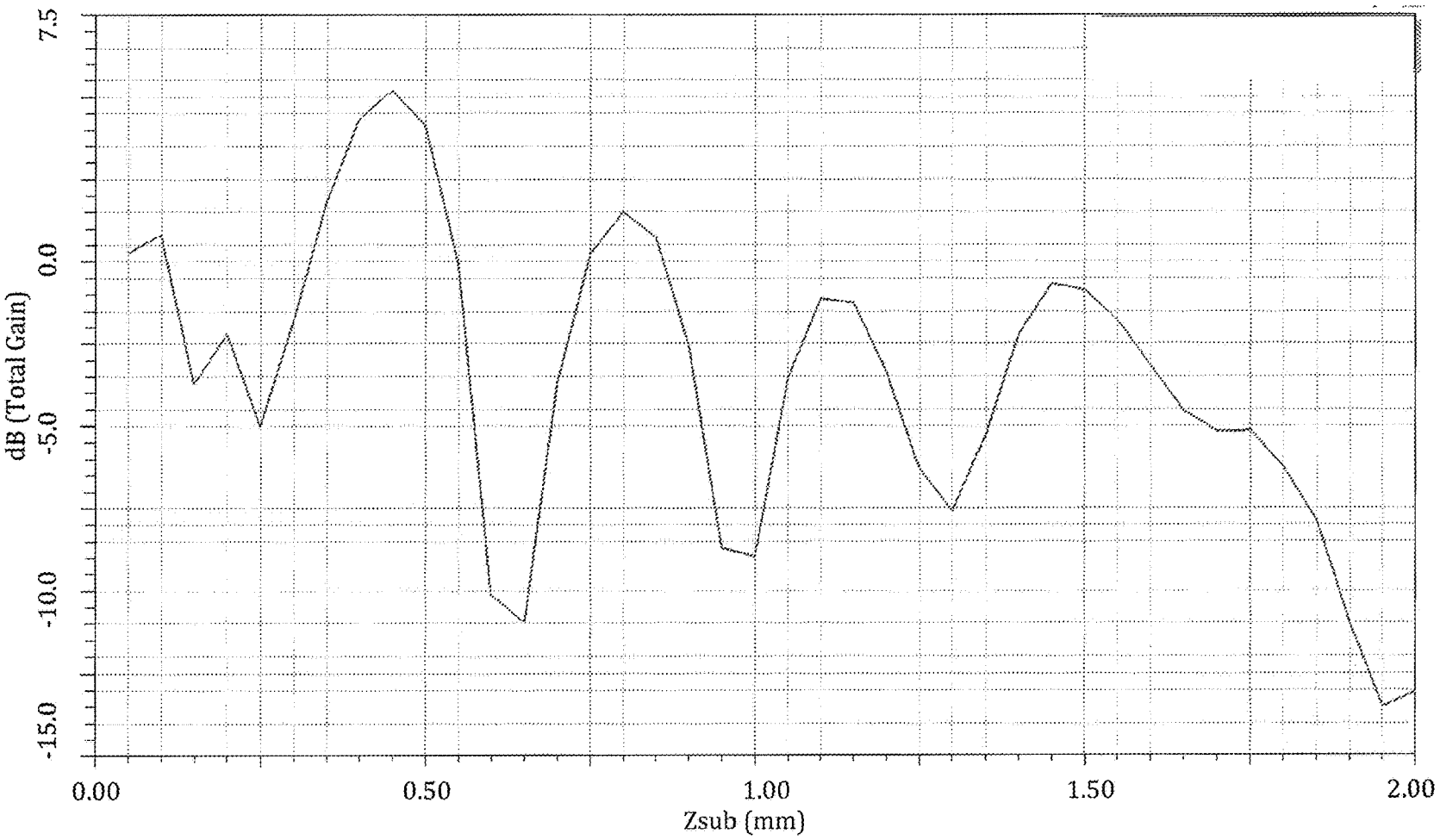
FIG. 7 is a graph of gain as a function of substrate thickness (Zsub).

FIG. 7 is a graph of gain as a function of substrate thickness (Zsub). The plot in FIG. 7 shows how the gain changes based upon substrate thickness. The maxima occur when the substrate is M×wavelength/4 (e.g., $M\lambda/4$), where M is an odd integer, as the reflections off of the bottom ground plane receive a 180° phase shift, and travel the distance of the thickness of the substrate twice before reaching the top of the chip again with a complete 360° phase shift which adds coherently with the radiated waves leaving the radiating elements in the positive z axis. When M is even, they add out of phase and efficiency goes down. From the maximum to the minimum emission efficiency, this effect can have more than 15 dB change in gain.

An important observation is that in order to have very low input impedances, the current between the radiator and the ground (virtual or real) will be almost constant. If the currents all are in phase and come back to the starting point to form a loop, they will cancel in the +Z direction in the far field.

One approach to avoid this outcome is to not have the currents come back to the starting point as in the linear multi-port driven radiator. An alternative solution is to not drive all of the output stages in phase. To create symmetry one way of implementing this out of phase radiator is to mimic a traveling wave on a ring, as seen in FIG. 8. FIG. 8 is a schematic diagram of an embodiment of a differential radial multi-port driven radiator with a loop topology. A central oscillator can be placed at the center of the radiator loop, and can send out input signals through the 'spokes' to amplifier stages along the exterior.

If each input is driven differentially, so that each differential pair is driven with a phase addition compared to the previous pair in such a way that the phase difference is 360° around the entire ring, a sort of travelling wave is produced. With 2 driver stages, a standing wave is produced, as there is no asymmetry to drive the wave either clockwise or counter clockwise around the loop. This standing wave can be considered as a degenerate travelling wave. With 4 stages driven at the phases 0°, 90°, 180° and 270°, a traveling wave is formed. A center feed structure can also be considered as seen in FIG. 8.

We now provide a brief analysis of the design issues using a 360° (2π radians) phase shift (or an integral multiple of 360°, or 2Nπ radians where N is an integer other than zero) around the ring. In order to have continuous phase shift with no jumps, the cumulative, or total, phase shift must be N×360° as the same point on the ring must have the same phase. For any even integer N, the phase on the opposite side of the ring will be in phase with the phase on the near side of the ring, and all currents will cancel each other out in the far field in the positive z axis. That is, the relative phase of the wave propagating around the ring will be the same on opposite sides of a "diameter" of the loop. For N=1 or other higher odd integer N, the currents on opposite sides of a "diameter" will not be exactly in phase, so such a design would provide a far field signal. For odd integer N, a design that requires 16*N spokes to achieve a 22.5° phase shift between drive points may become complex to fabricate, and at present would be difficult because present semiconductor foundries generally allow angular relationships of not less than 45° for metal lines. Therefore, at present, a design having N=1 is a preferred embodiment.

A 4 stage feed structure will allow for a centrally placed ring oscillator to drive the circuit, and send phase shifted input signals down the 'spokes' of the radiator. Because the spokes are perpendicular to the closest sections of the radiator at all times, they have little effect on the radiator. With 90° shifts however, the concept of a virtual ground in the center of the lines is lost, and in fact the trailing amplifier will actually accept power rather than provide power. It is apparent that the phase shift must be more than 0° to induce a travelling wave, but less than 90° to allow all amplifier stages to provide power. Using 8 spokes, the phase shift is reduced to 45° between adjacent spokes. This approaches the goal, but the asymmetry between the leading transistor and the trailing transistor in the differential pair is appreciable. Using 16 spokes and a 22.5° phase shift between adjacent spokes appears to be a good compromise between the asymmetry of the leading and lagging transistors, and the need for a phase shift to induce a travelling wave.

Figure 9:
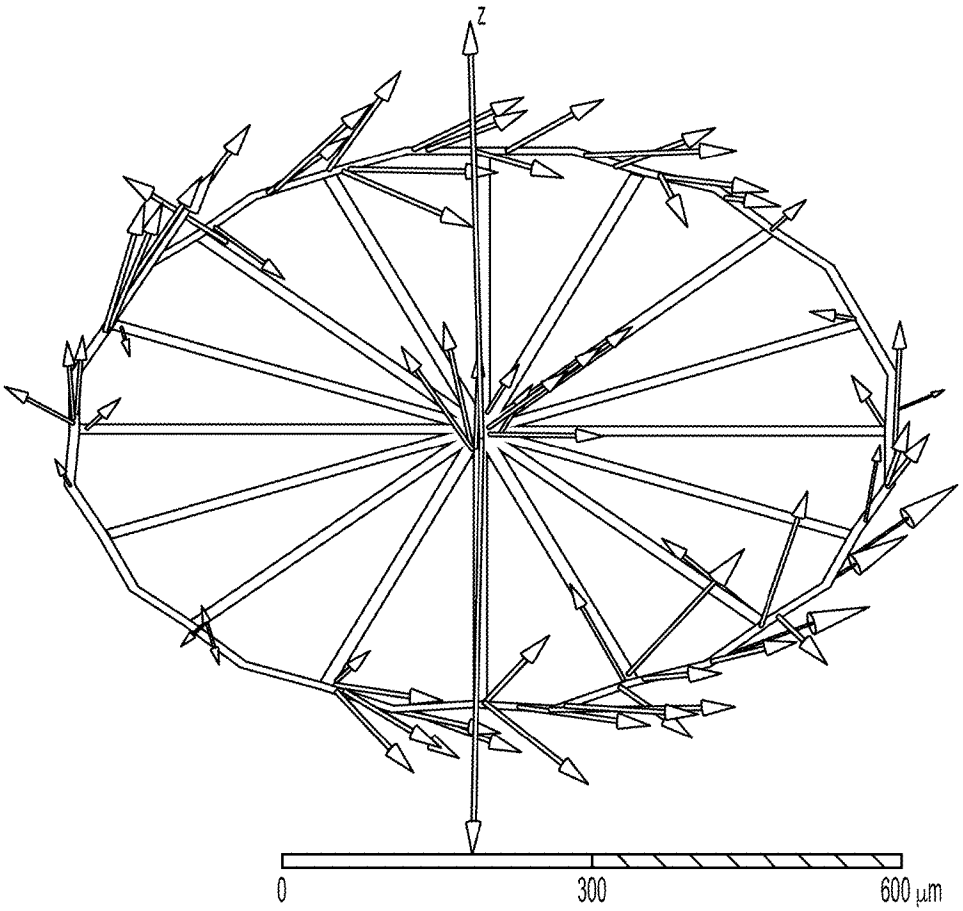
FIG. 9 is a plot of the current density in the multi-port driven radiator of FIG. 8 at 0° phase.

FIG. 9 is a plot of the current density in the differential radial multi-port driven radiator of FIG. 8 at 0° phase. As can be seen, the currents on opposite sides of the radiator are in phase.

Figure 10:
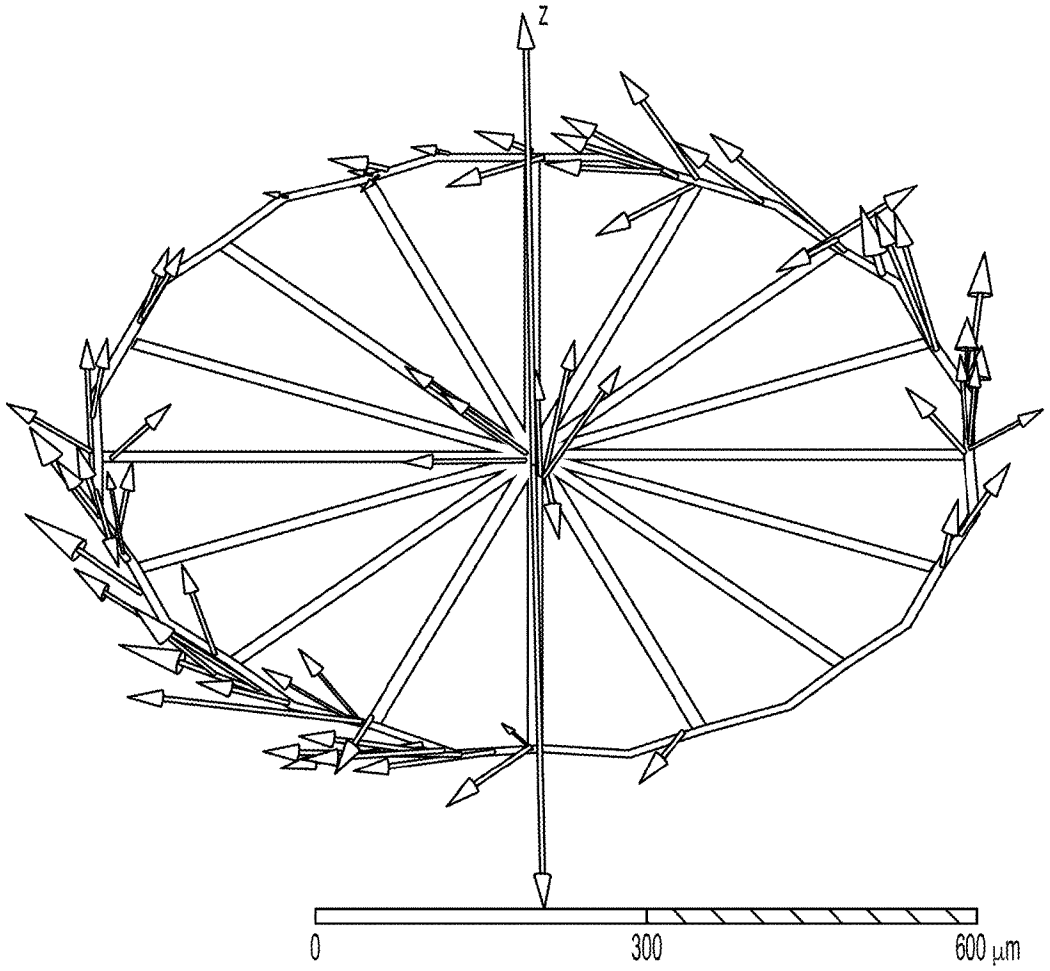
FIG. 10 is a plot of the current density in the multi-port driven radiator of FIG. 8 at 90° phase.

FIG. 10 is a plot of the current density in the differential radial multi-port driven radiator of FIG. 8 at 90° phase. The examination of this and other phase points show that there is indeed a traveling wave being produced around the loop structure.

FIG. 11 is a schematic diagram of a second embodiment of a differential radial multi-port driven radiator in a loop topology. The embodiment of FIG. 11 includes a ground plane and DC power/input signal feeds. This structure could either have a ground plane on the bottom to facilitate front-side radiation, or could leave the backside open and radiate in that direction. For the following plot, backside radiation is considered.

Figure 12:
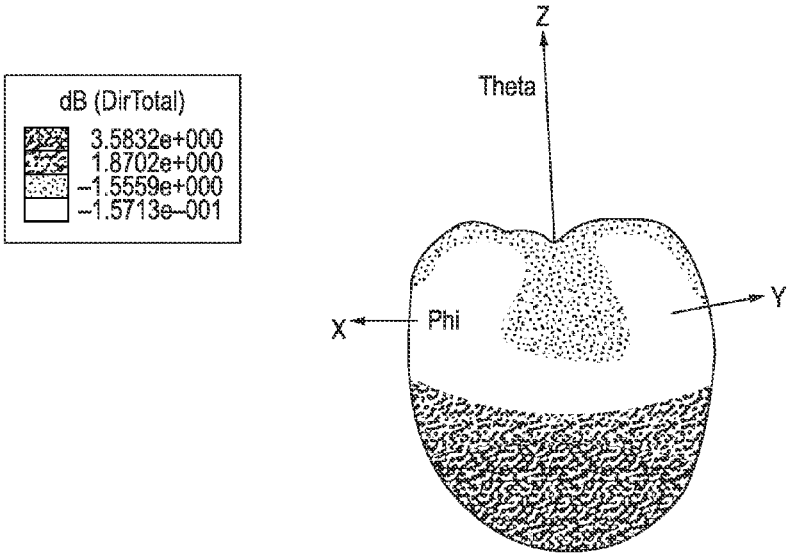
FIG. 12 is a three dimensional plot of the radiation pattern emitted by a differential radial multi-port driven radiator with a loop topology.

FIG. 12 is a three dimensional plot of the radiation pattern emitted by an active multidrive radiator in a loop topology. The radiation pattern of FIG. 12 shows a broad beam that is appropriate for putting into a phased array. Such an array of these devices would allow for beam steering with the addition of phase shifters between loops. It has also been observed that traveling, circularly polarized waves do not create nearly as much substrate loss as standing waves that are linearly polarized. This effect can be used to increase the efficiency of such a structure.

These fundamental embodiments can be further improved through the use of digital and/or analog programming of the amplitudes and phases of the input signals and/or power supplies. In such an embodiment, features of the radiation that can be programmed include steering the beam, adjusting the beam width, modifying the output power level, modifying the efficiency and adding a modulated signal on top of the fundamental carrier as well as other improvements to desired performance specifications. These programmable controls can be implemented using a general purpose programmable computer operating under a set of instructions recorded on a machine readable medium, or alternatively can be controlled by hardwired logic.

Another possible embodiment is to adapt the differential radial MPD into a single ended version. The single ended radial MPD radiator uses an unbroken loop that is pumped by the driving circuitry at various points along the loop single ended. The phases of each drive around the loop will still be spaced substantially evenly in a similar manner to the differential version. The radial ground currents created by the active drivers of the single ended radial MPD can also be designed to radiate coherently with the signal current in the loop. This is accomplished by creating ground 'spokes' that direct the ground currents radially perpendicular to the nearest point on the ring, resulting in radial standing current waves along the spokes and a virtual ground at the center of the radiator.

Figure 13A:
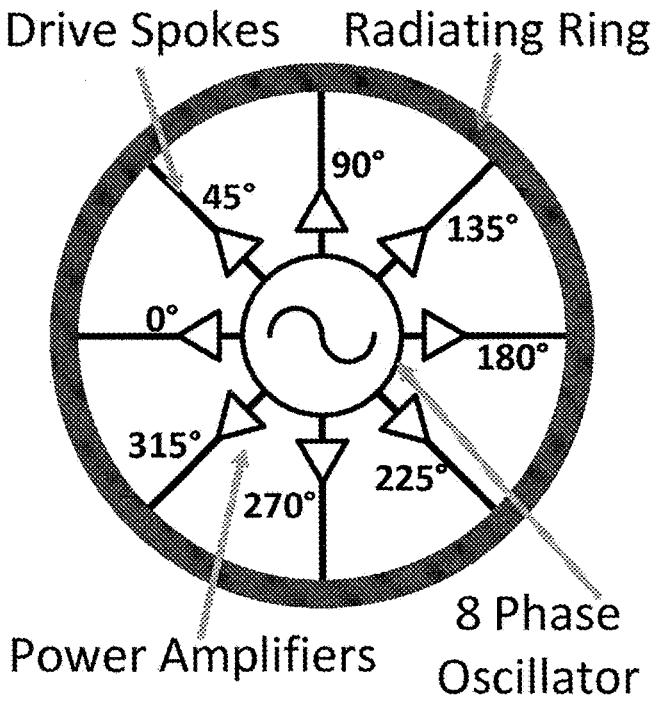
FIG. 13A is a schematic block diagram of an embodiment of a single-ended radial multi-port driven (MPD) radiating source having 8 drive spokes in a periodic structure.
Figure 13B:
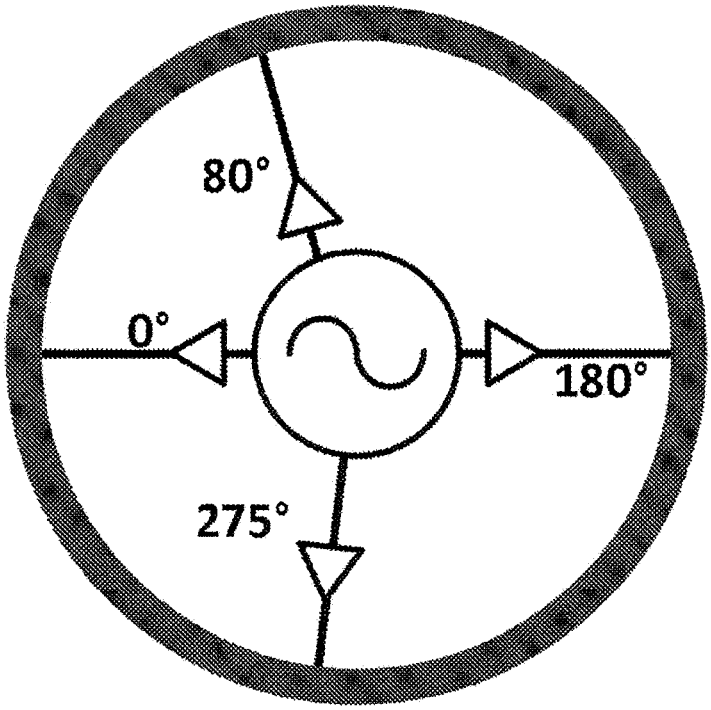
FIG. 13B is a schematic block diagram of an embodiment of a single-ended radial multi-port driven (MPD) radiating source having 4 drive spokes in a non-periodic structure.

FIG. 13A is a schematic block diagram of an embodiment of a single ended radial multi-port driven (MPD) radiating source having 8 drive spokes in a periodic structure.

Figure 14:
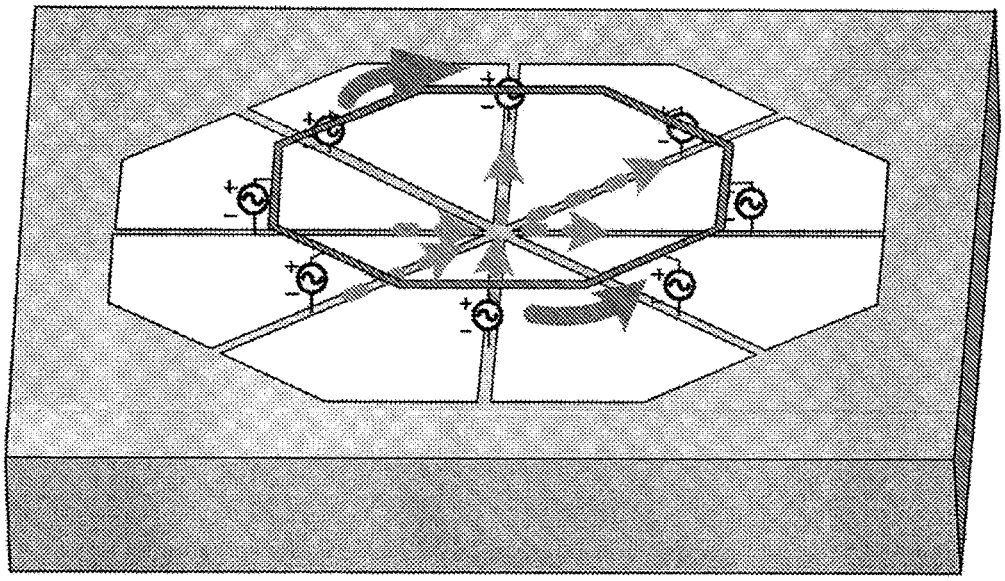
FIG. 14 is a schematic diagram of the instantaneous current distribution on antenna signal and ground paths at 0° phase.

FIG. 14 is a schematic diagram of the instantaneous current distribution on antenna signal and ground paths at 0° phase. Traveling wave currents are shown as solid arrows, while standing wave currents are shown by dashed arrows. The peak traveling wave current in the ring leads the peak injected current by about 45°, and thus the travelling signal wave on the ring and standing radial ground wave on the spokes are adding primarily constructively in the far field. In order to create the traveling wave on the ring, at least 3 drives are required, but for practical design purposes a power of two (e.g., $2^X$, where X is an integer greater than or equal to 2) is preferable for the number of spokes. In the embodiment of FIG. 14, X=3. The ground spokes provide shielding for signal feed lines that connect the oscillator and amplifier core out to the ring by providing a closed path for the return current. The spokes are extended out to a ground plane that is placed at a farther distance to the center to ensure that most of the RF ground currents go through the center of the radiator. These spoke extensions also allow for DC supply lines to be shielded from picking up any of the radiated signal.

The silicon substrate has a dielectric constant 11.7 times that of air, and thus most of the power that is radiated goes down into the substrate. While it is possible to radiate out of the backside of the chip this way, due to the practical thermal and packaging concerns it is preferable to radiate from the top side by mounting the chip on a conductive backplane.

Reduction to Practice

An 8-spoke exemplary single ended radial MPD radiating source comprising active drive circuitry and a loop MPD antenna operating at 160 GHz was designed and fabricated in a 130 nm SiGe BiCMOS process with two 3 μm copper top metal layers. The total area available within the center of the radiator is small, and thus it is preferable to employ a power oscillator to provide sufficient power directly. A single amplifying stage is used next to amplify the signal and provide reverse isolation between the radiator and oscillator. The central oscillator is a 4-stage differential ring oscillator that provides eight phases 45° apart.

FIG. 15 is a schematic circuit diagram of an 8-phase ring oscillator and power mixer, in which the bias circuitry is omitted for simplicity. Each stage is a cascode stage for increased power and voltage swing, and employs tuned metal capacitors for ac-coupling of the stages. The results of O. Momeni and E. Afshari, "High Power Terahertz and Millimeter-Wave Oscillator Design: A Systematic Approach," *IEEE J. of Solid-State Circuits*, vol. 46, no. 3, pp. 583-597, March 2011 are used to determine the inter-stage connections of the oscillator. Each of the eight oscillator phases is then fed to a cascode amplifying stage, which provides 6 dB gain and −7 dBm output power at 160 GHz each in simulation for a total simulated output power of 2 dBm. FIG. 16 is a circuit diagram of a power amplifier. The MPD antenna has a simulated radiation efficiency of 24%, and directivity of 8.8 dB, yielding a gain of 2.5 dBi, and a maximum equivalent isotropic radiated power (EIRP) of 4.5 dBm.

The chip was thinned to around 190 μm, mounted on a PCB, and attached to a 2-D stepper motor setup to measure the antenna pattern. The pattern was measured using a receiver comprising a 23.4 dB gain linearly polarized horn antenna and a $10^{th}$ harmonic WR-6 mixer fed into a spectrum analyzer. The receiver was calibrated using a 160 GHz tripler source and an Erikson power meter. All measurements were taken with a separation of 75 mm, or 40 at 160 GHz. The chip was rotated in the x-y plane and confirmed to have circular polarization. The radiator was measured to have a maximum 4.6 dBm EIRP, at a frequency of 161.45 GHz while dissipating 384 mW, in close agreement with simulation.

The calibrated power spectrum observed at the receiver is depicted in FIG. 17. The radiation pattern was measured, and shows a total radiated output power of −2 dBm. Two perpendicular slices of the radiation pattern measured by rotating the chip in the elevation and azimuth planes are presented in FIG. 18A and FIG. 18B. FIG. 18A is a plot of the simulated and measured antenna patterns in the elevation plane. FIG. 18B is a plot of the simulated and measured antenna patterns in the azimuth plane.

Figure 19:
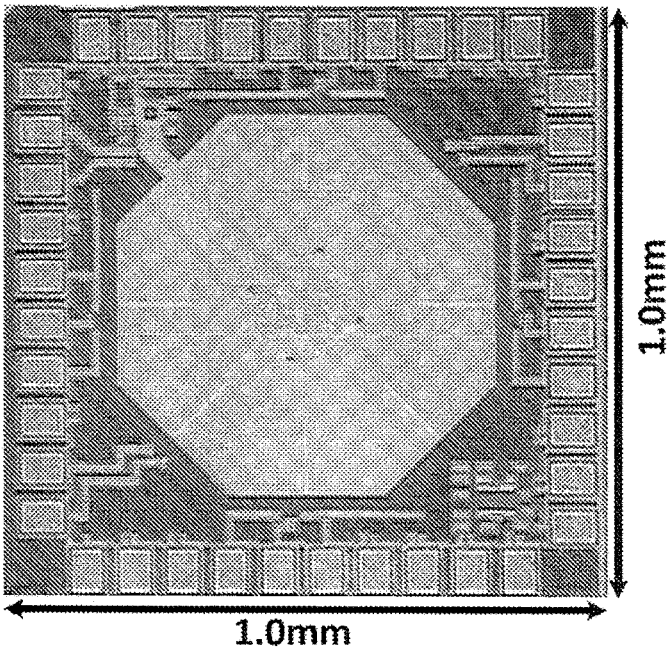
FIG. 19 is an image of a die containing an embodiment of the single-ended radial MPD radiating source a table providing a comparison of integrated (on-chip) silicon radiators above 100 GHz.

FIG. 19 is an image of a die containing an embodiment of the single ended radial MPD radiating source that was fabricated and tested.

A Table that provides a comparison of integrated (on-chip) silicon radiators above 100 GHz is shown in FIG. 20. To the best of the authors' knowledge, this work shows the highest reported on-chip radiated power in silicon above 100 GHz. In the Table, the reference numbers [1], [2], [4], [5] and [6] represent the work described in the publications listed below. References [4], [5] and [6] describe single port antenna structures.

[1] K. Sengupta and A. Hajimiri, "Sub-THz beam-forming using near-field coupling of Distributed Active Radiator arrays," *Radio Frequency Integrated Circuits Symposium* (*RFIC*), June 2011;

[2] K. Sengupta and A. Hajimiri, "A 0.28 THz 4×4 power-generation and beam-steering array," *International Solid State Circuits Conference Digest* (*ISSCC*), pp. 256-258, February 2012.

[4] E. Laskin, et al., "170-GHz transceiver with on-chip antennas in SiGe technology," *Radio Frequency Integrated Circuits Symposium Digest* (*RFIC*). pp. 637-640, June 2008;

[5] A. Tang, et al, "*A* 144 *GHz* 0.76 *cm-resolution sub-carrier SAR* phase radar for 3D imaging in 65 nm CMOS," *International Solid State Circuits Conference Digest* (*ISSCC*), pp. 264-266, February 2012; and

[6] J. D. Park, et al., "A 0.38 THz fully integrated transceiver utilizing quadrature push-push circuitry," *Symp. on VLSI Circuits* (*VLSIC*), pp. 22-23, June 2011.

Definitions

Recording the results from an operation or data acquisition, such as for example, recording results at a particular frequency or wavelength, is understood to mean and is defined herein as writing output data in a non-transitory manner to a storage element, to a machine-readable storage medium, or to a storage device. Non-transitory machine-readable storage media that can be used in the invention include electronic, magnetic and/or optical storage media, such as magnetic floppy disks and hard disks; a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. Unless otherwise explicitly recited, any reference herein to "record" or "recording" is understood to refer to a non-transitory record or a non-transitory recording.

As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes. Recording image data for later use (e.g., writing an image to memory or to digital memory) can be performed to enable the use of the recorded information as output, as data for display to a user, or as data to be made available for later use. Such digital memory elements or chips can be standalone memory devices, or can be incorporated within a device of interest. "Writing output data" or "writing an image to memory" is defined herein as including writing transformed data to registers within a microcomputer.

"Microcomputer" is defined herein as synonymous with microprocessor, microcontroller, and digital signal processor ("DSP"). It is understood that memory used by the microcomputer, including for example instructions for data processing coded as "firmware" can reside in memory physically inside of a microcomputer chip or in memory external to the microcomputer or in a combination of internal and external memory. Similarly, analog signals can be digitized by a standalone analog to digital converter ("ADC") or one or more ADCs or multiplexed ADC channels can reside within a microcomputer package. It is also understood that field programmable array ("FPGA") chips or application specific integrated circuits ("ASIC") chips can perform microcomputer functions, either in hardware logic, software emulation of a microcomputer, or by a combination of the two. Apparatus having any of the inventive features described herein can operate entirely on one microcomputer or can include more than one microcomputer.

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of UNIX, or of Linux. Computational results obtained in the operation of the general purpose computer can be stored for later use, and/or can be displayed to a user. At the very least, each microprocessor-based general purpose computer has registers that store the results of each computational step within the microprocessor, which results are then commonly stored in cache memory for later use, so that the result can be displayed, recorded to a non-volatile memory, or used in further data processing or analysis.

Many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein, so long as at least some of the implementation is performed in hardware.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A multi-port driven antenna, comprising:

an antenna structure having a length L, said antenna structure comprising a conductor and configured to radiate electromagnetic radiation, said radiator structure having at least one ground contact point and a plurality S of input ports, where S is a positive integer greater than or equal to 2, each of said plurality S of input ports having a respective electrical connection to said antenna at a respective selected location along the antenna length L;

a respective signal input terminal of each of said plurality S of input ports, each signal input terminal configured to receive a respective input signal having a predetermined phase relationship with respect to another input signal applied to an adjacent signal input terminal, said predetermined phase relationship dependent on said location of said respective electrical connection to said antenna, said respective signal input terminal configured to apply said received respective signal to said antenna structure at said respective selected location of said input port; and at least one ground plane adjacent said antenna structure, wherein said antenna structure having a length L is a loop structure.

2. The multi-port driven antenna of claim 1, further comprising:

a source of input signals, said source configured to provide to each of said respective signal input terminal of each of said plurality S of input ports said respective input signal having a predetermined phase relationship with respect to another input signal applied an adjacent signal input terminal, and configured to provide a ground signal at each of said at least one ground contact point; said multi-port driven antenna and said source of input signals when active defining a multiport-driven radiator.

3. The multi-port driven antenna of claim 2, wherein said source of input signals includes an amplifier configured to amplify at least one of said respective input signals.

4. The multi-port driven antenna of claim 1, wherein each of said plurality S of input ports has a respective electrical connection separated by a length L/S from a location of an adjacent input port.

5. The multi-port driven antenna of claim 2, wherein said signal source is a multiphase oscillator.

6. The multi-port driven antenna of claim 5, wherein said multi-phase oscillator is configured to provide $2^x$ phases, where X is an integer greater than or equal to 2.

7. The multi-port driven antenna of claim 1, wherein said antenna is configured to radiate millimeter wave electromagnetic radiation.

8. The multi-port driven antenna of claim 1 fabricated on a semiconductor wafer.

9. The multi-port driven antenna of claim 1, further comprising a controller configured to control an amplitude and a phase of each of said respective input signals.

10. The multi-port driven antenna of claim 1, further comprising a controller configured to control a power supply.

11. The multi-port driven antenna of claim 1, configured as one of a plurality of multi-port driven antennas in a phased array configuration.

12. The multi-port driven antenna of claim 1, wherein said antenna structure having a length L is a linear structure.

13. A method of generating electromagnetic radiation, comprising the steps of:

providing an antenna comprising:

an antenna structure having a length L, said antenna structure comprising a conductor and configured to radiate electromagnetic radiation, said radiator structure having at least one ground contact point and a plurality S of input ports, where S is a positive integer greater than or equal to 2, each of said plurality S of input ports having a respective electrical connection to said antenna at a respective selected location along the antenna length L;

a respective signal input terminal of each of said plurality S of input ports, each signal input terminal configured to receive a respective input signal having a predetermined phase relationship with respect to another input signal applied an adjacent signal input terminal, said predetermined phase relationship dependent on said location of said respective electrical connection to said antenna, said respective signal input terminal configured to apply said received respective signal to said antenna structure at said respective selected location of said input port; and at least one ground plane adjacent said antenna structure, wherein said antenna structure having a length L is a loop structure; and applying each of a plurality S of input signals each having a frequency ω to a respective signal input terminal of each of said plurality S of input ports.

14. The method of generating electromagnetic radiation of claim 13, wherein said integer S is three or larger.

15. The method of generating electromagnetic radiation of claim 13, wherein said integer S is a power of 2.

16. The method of generating electromagnetic radiation of claim 13, wherein said integer S is 8.

17. The method of generating electromagnetic radiation of claim 13, wherein said electromagnetic radiation is millimeter wave electromagnetic radiation.

* * * * *